United States Patent [19]

Kogan

[11] 4,218,792

[45] Aug. 26, 1980

[54] ORTHOPAEDIC PILLOW

[75] Inventor: Henry Kogan, Paris, France

[73] Assignee: Condor, Paris, France

[21] Appl. No.: 783

[22] Filed: Jan. 3, 1979

[30] Foreign Application Priority Data

Oct. 3, 1978 [FR] France ..... 78 28211

[51] Int. Cl.[3] ..... A47G 9/00

[52] U.S. Cl. ..... 5/436; 5/447; 5/464; 297/391

[58] Field of Search ..... 5/434, 435, 436, 437, 5/440, 441, 446, 447, 490, 431, 464, DIG. 2; D6/201-204; 128/68; 297/391

[56] References Cited

U.S. PATENT DOCUMENTS

| | | | |
|---|---|---|---|
| 2,835,905 | 5/1958 | Tomasson | 5/338 |
| 3,028,610 | 4/1962 | Talalay | 5/DIG. 2 |
| 3,133,853 | 5/1964 | Knox | 5/DIG. 2 |
| 3,482,571 | 12/1969 | Bemrendt | 5/338 |
| 3,487,134 | 12/1969 | Burr | 5/337 |
| 3,829,917 | 8/1974 | De Laittre | 5/338 |

FOREIGN PATENT DOCUMENTS

| | | | |
|---|---|---|---|
| 2263740 | 10/1975 | France | 5/436 |

*Primary Examiner*—Roy D. Frazier
*Assistant Examiner*—Alexander Grosz
*Attorney, Agent, or Firm*—Browdy and Neimark

[57] ABSTRACT

The orthopaedic pillow is made of a block of cellular material having the consistence of a latex foam and having, as seen in plan, substantially the shape of a rectangle or a trapezium, the large side or the large base of which is formed with a concave frontal curvature, the top of the block bounding a concavity in the medium portion of the curved edge and said concavity being continued by a recess.

12 Claims, 5 Drawing Figures

ORTHOPAEDIC PILLOW

The present invention relates to a novel orthopaedic pillow for preventing abnormal deformations of the rachis when the patient is lying on his back as well as on his side.

Pillows of this type have already been proposed and comprise mostly a portion in expanded material or in horse hair, with a configuration such as to delimit one region for the head and one for the neck.

Till now, it has appeared as necessary to make pillows in several portions, one being in a material relatively hard such as horse hair, compressed felt, semiflexible plastic materials or similar, and to coat said relatively hard portion with a cover made of a flexible sheet forming a damping element. Thus, the existing pillows are of relatively expensive construction.

The present invention relates to a novel onepiece pillow which can of course be enclosed inside a fabric pillowcase.

According to the invention, the orthopaedic pillow is made of a block of cellular material having the consistence of a latex foam and having, as seen in plan, substantially the shape of a rectangle or a trapezium, the large side or the large base of which is formed with a concave frontal curvature, the top of the block bounding a concavity in the medium portion of the curved edge and said concavity being continued by a recess.

Further other features of the invention will become more apparent from the following description of non limitative embodiments thereof, reference being made to the accompanying drawings wherein.

Figure 1:
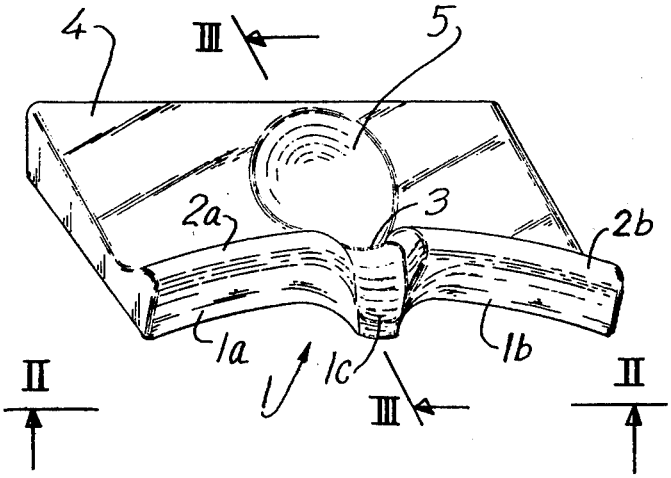
FIG. 1 is a top perspective view of the orthopaedic pillow according to the invention.
Figure 2:
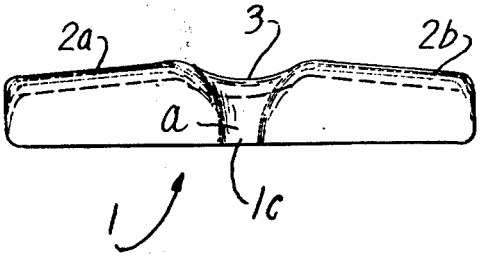
FIG. 2 is an elevation view taken substantially along line II—II of FIG. 1.
Figure 3:
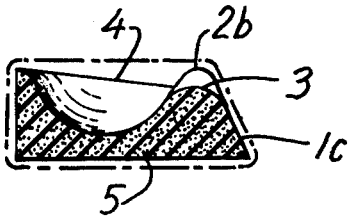
FIG. 3 is a cross-sectional view taken substantially along line III—III of FIG. 1.

The pillow shown in the drawings is a onepiece block made from latex foam or from a synthetic resin of similar consistence. Preferably, a material is chosen which provides communication between the alveoles formed therein. The communication between the alveoles provides damping qualities which are superior to what they are when a closed alveole material is used, and this prevents also the user from perspiring particularly in the region of the nape of the neck.

As is shown in the drawings, the configuration of the pillow is, viewed in plan, substantially that of a rectangle or of a trapezium, one of the large sides of which in the case of a rectangle, or the large base in the case of a trapezium, being shown at 1, and as illustrated in the drawings, bounds a concave frontal curvature with pads 1*a*, 1*b* converging towards each other. A convex boss 1*c* projects from the block in the medium portion of side 1 for corresponding to the position of the nape of the neck.

The front face of boss 1*c* is concave as shown at a. The upper portion of the pillow bordering side 1 delimits two projecting edges 2*a*, 2*b* the upper portion of which is rounded. The two projecting edges 2*a*, 2*b* are separated by a concavity 3 forming the initiation of concavity a formed in the front face of boss 1*c*. The depth of the concavity 3 is such that its lowest portion is nevertheless situated at least on the level of the top 4 of the pillow or, preferably, slightly above the level of the top portion which is closest to concavity 3. The top 4 is inclined towards the bottom from the rear of the pillow up to the projecting edge 2 and, in a manner known per se, a concavity 5 is provided in the top 4 behind concavity 3.

As is apparent from the above description, the cavity 5 is provided for housing the head, particularly the occipital portion when the nape lies in the concavity 3.

The shape, curvature or convergence of the frontal edge 1 provides a housing for the shoulders, whereas the boss 1*c* provides the support of the cervical vertebrae, and this whether the user is lying on his back or on his side.

In an alternative not shown, the pads 1*a*, 1*b* may be omitted but, in this case, it is advantageous that the top 4 be substantially horizontal instead of being inclined.

Figure 4:
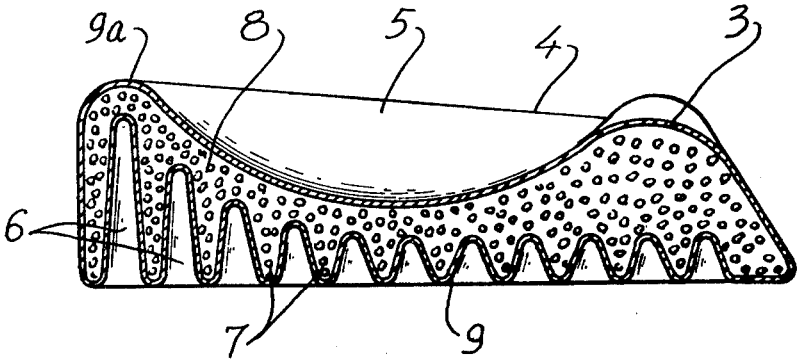
FIG. 4 is an elevation cross-sectional view similar to that of FIG. 3, but at a larger scale and illustrating an advantageous embodiment of the orthopaedic pillow of the previous figures.

For some users, the pillow has to be formed with portions of variable hardness in order to provide an efficient support while preserving a great comfort and an appreciable flexibility in other portions. To this end, and as is shown in FIG. 4, the under portion of the pillow has a configuration such that it has alveoles 6 separated by ribs 7.

The width of the alveoles as well as that of the ribs may be chosen at will so that some portions of the pillow are more or less rigid. As a matter of fact, when molding and taking in account the materials chosen for making the pillow, it is possible to obtain that the latter has a more or less fixed skin all over its surface, that is as well on the top portion 4 than on the portions bordering the alveoles 6. As a matter of fact, when a synthetic resin or an elastomer incorporating a swelling agent is being injected in a mold, it can be arranged that the portions of the injected material which come in direct contact with the mold walls be quickly cooled down and do not develop into a foam.

By adjusting the width of the alveoles 6, the thickness of the foam 8 which is finally formed in the pillow is adjusted accordingly and it can be arranged that a foam layer of uniform or non uniform thickness be formed in the vicinity of all or part of the top of the pillow so that the lower portion of the pillow is relatively rigid and is covered with a foam cushion which can be very flexible.

If it is seen to it that the part of the mold which forms the ribs 7 is quickly cooled down, whereas the portion of the mold delimiting the top portion 4, and by way of consequences the various concavities of the pillow, are maintained at a higher temperature, one obtains that the skin 9 of the ribs 7 is thick, whereas the skin 9*a* of the top portion 4 is very thin, and consequently, although being made as a one piece article, the pillow may have a bottom portion relatively rigid and a very flexible surface.

Figure 5:
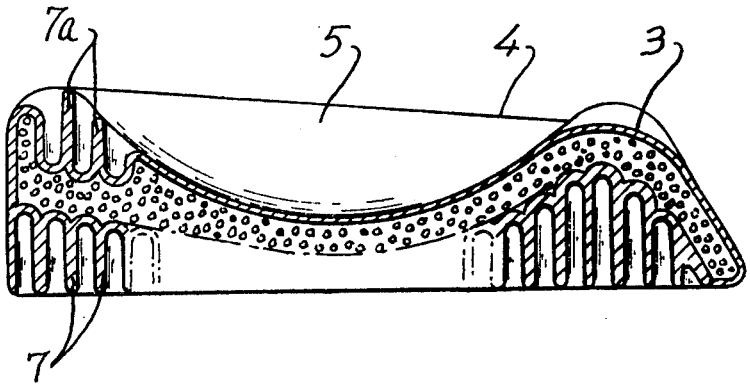
FIG. 5 shows a development of the embodiment of FIG. 4.

FIG. 5 illustrates a further embodiment according which some portions of the top of the pillow are also formed with ribs 7*a*, whereby said ribs may be compact or on the contrary have a foamed skin and core, which is obtained as explained hereabove either by regulating the thickness or the width of the ribs, or by regulating the temperature of some of the portions of the mold wall.

The invention is not limited to the embodiment herein shown and described in detail and various modifications may be carried out without departing from the scope thereof. Particularly, the ribs may extend in several directions.

What is claimed is:

1. An orthopaedic pillow comprising a block of cellular foamed material, said block having a general consistence of latex foam and presenting, viewed in a plane, substantially the shape of a four-sided geometric figure having having two long sides and two relatively shorter sides, one of said long sides having a concave frontal curvature, the top of said block delimiting a concavity in its medium portion extending to said concave frontal curvature, said concavity being continued rearwardly by a recess into which a user's head can be placed; a convex boss projecting forwardly from the frontal curvature of said block for receiving the nape of a user's neck, and means for providing differing degrees of hardness from one portion of the pillow to another.

2. A pillow according to claim 1, including a projecting edge projecting upwardly from said concave frontal curvature on said top, said projecting edge delimiting a medium concavity the bottom of which is at least in alignment with said top of said block.

3. A pillow according to claim 2, wherein said medium concavity is continued by said boss which projects from said concave frontal curvature.

4. A pillow according to claim 1, wherein said concave frontal curvature with a substantially parallel bottom edge of said block defines a configuration adapted to the shape of the shoulders of a user.

5. A pillow according to claim 1, wherein said block presents when viewed in a plane substantially the shape of a rectangle.

6. A pillow according to claim 1, wherein said block presents when viewed in a plane substantially the shape of a trapesium.

7. A pillow according to claim 1, wherein said block is made of a flexible material with open alveoles, said open alveoles comprising said means for providing a differing hardness from one portion of the pillow to another.

8. A pillow according to claim 1, wherein at least a portion of said block constituting its underside is formed with alveoles delimited by ribs extending in at least one direction and constituting said means providing differing hardness from one portion of the pillow to another.

9. A pillow according to claim 8, wherein said ribs are made of compact material.

10. A pillow according to claim 8, wherein said ribs are formed of a compact skin and and a foamed core.

11. A pillow according to claim 10, wherein said ribs are delimited so that said foamed core extends to the vicinity of the top of said block.

12. A pillow according to claim 8, wherein said ribs have a skin and the top of said block is formed with a compact skin having a lesser thickness than said skin of said ribs.

* * * * *